United States Patent [19]

Foster, Jr. et al.

[11] Patent Number: 4,825,791

[45] Date of Patent: May 2, 1989

[54] OCEAN TRANSPORT OF PRE-FABRICATED OFFSHORE STRUCTURES

[75] Inventors: Isaac R. Foster, Jr.; Robert E. Howson; Donald Payne, all of New Orleans, La.

[73] Assignee: McDermott International, Inc., New Orleans, La.

[21] Appl. No.: 741,024

[22] Filed: Jun. 3, 1985

Related U.S. Application Data

[63] Continuation of Ser. No. 522,070, Aug. 10, 1983, abandoned.

[51] Int. Cl.[4] ..... B63B 35/44

[52] U.S. Cl. ..... 114/72; 114/258; 114/264; 405/203

[58] Field of Search ..... 114/258, 259, 260, 31–33, 114/264, 75, 77 R, 72; 414/137; 405/203, 206, 209

[56] References Cited

U.S. PATENT DOCUMENTS

| | | | |
|---|---|---|---|
| 3,417,721 | 12/1968 | Vienna | 114/77 R |
| 3,556,036 | 1/1971 | Wells | 114/72 |
| 4,086,777 | 5/1978 | Lai | 114/258 |

FOREIGN PATENT DOCUMENTS

| | | | |
|---|---|---|---|
| 53-27985 | 3/1978 | Japan | 114/260 |

OTHER PUBLICATIONS

Gemini, Brown and Root, Inc., G. J. Blight et al., Mar. 31, 1978.

*Primary Examiner*—Joseph F. Peters, Jr.
*Assistant Examiner*—Edwin L. Swinehart
*Attorney, Agent, or Firm*—Robert J. Edwards; D. Neil LaHaye; James C. Simmons

[57] ABSTRACT

A system and method for ocean transport of prefabricated offshore structures includes a self-propelled seagoing vessel having a submergible mid deck and one or more raised decks. Ballasting equipment is provided in the vessel for submerging the mid deck to a level at least deep enough to permit the floating of a shallow draft barge over the mid deck. The shallow draft barge carries a prefabricated offshore structure such as a drill jacket. The barge with the offshore structure loaded thereon is floated over the submerged mid deck, and the vessel is then deballasted to raise the mid deck. With the barge lifted out of the water, the barge is fixed to the vessel which may then transport the barge and its cargo over an ocean to any offshore drilling site.

4 Claims, 9 Drawing Sheets

34
16
42
10
30
32
30
40
28

16
34
42
36
32
38
40
28

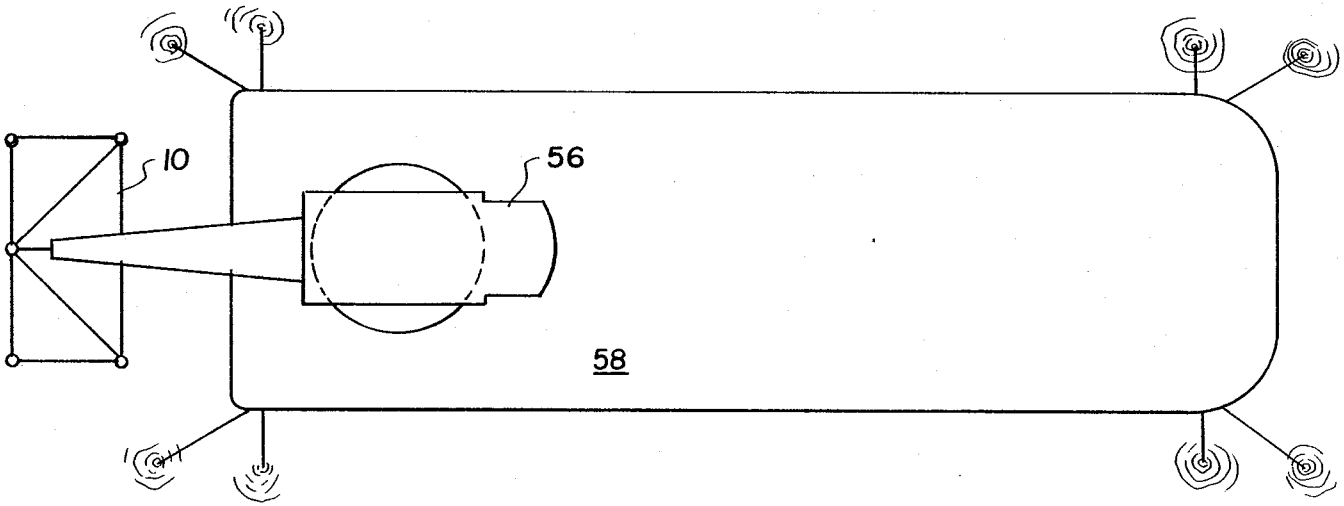
FIG. 13
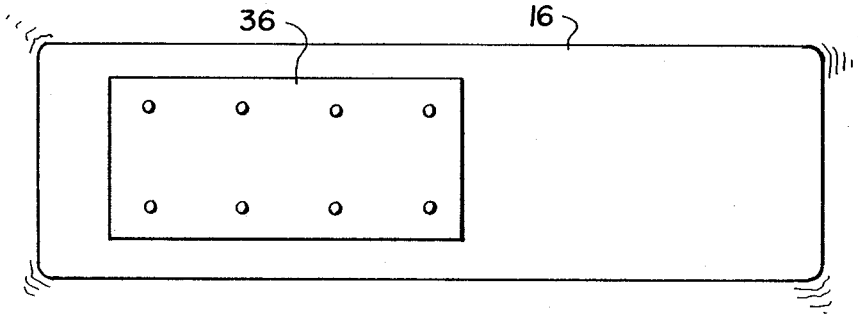

OCEAN TRANSPORT OF PRE-FABRICATED OFFSHORE STRUCTURES

This is a continuation of application Ser. No. 522,070, filed Aug. 10, 1983, now abandoned.

The present invention relates in general to the transport of prefabricated offshore structures, and more particularly to a vessel and barge system and method for deep ocean transport of drill jackets and other prefabricated offshore structures.

A drill jacket is an elongated offshore structure made up of a plurality of tubular members with cross bracing, which structure is installed by lowering it to rest on the sea bottom. The jacket is secured in this position and functions to support a deck unit and hydrocarbon production equipment above the water line. The deck unit, which usually comprises a flat deck area with a plurality of legs extending downwardly therefrom, provides support for the oil drilling and recovery equipment. These components make up an offshore facility.

The manufacture of prefabricated components of such an offshore facility has in the past required that the fabrication yards or sites be built relatively close to a final desired location for the facility. Most of these yards are located near shallow water areas. When components are fabricated in such yards, the components may be loaded onto barges having shallow drafts. The barges are then towed to the final location for installation of the facility. Such a procedure may be reliably accomplished safely if the seas are calm and if the duration of such a tow is no more than a day or two since weather forecasts for such short durations are usually fairly reliable. However, even though a tow may be of short duration, long delays may be experienced while waiting for calm seas. When these tows do arrive at the installation site, the barges may be moored in shallow water alongside the construction equipment at the site, which equipment may include, for example, cranes mounted on flat barges.

Offshore facility components may often be build more economically at fully integrated fabrication yards. However, due to existing favorable conditions at such fabrication yards and the quantity thereof being limited by the cost of building them, such fabrication yards may be located at extreme distances from the final offshore facility locations. The technical and safety risks of long tows, however, make it difficult for these remote yards to compete with fabrication yards located near the final offshore facility sites. Shallow draft barges for loading offshore structures in the typically shallow waters, because of the size and bulk of such structures, may be unstable in open sea thus requiring periods of calm weather for towing safety and, therefore, long delays may be experienced while waiting for these calm conditions. On long tows such as over an ocean, there is also no assurance, as previously noted, that good weather and calm seas will prevail throughout the transport. Rough seas may in addition cause severe fatigue or other damage to the offshore components during a tow by barge.

The fatigue stresses during such transport are increased with higher accelerations during the roll of the transport structure. Barges typically have a low period of roll with resulting high accelerations during the roll as compared to a self-propelled sea-going vessel. Furthermore, the total fatigue stresses on an offshore structure during a transport of specified length is related to the duration of transport. The speed of a barge being towed is typically slow as compared to the speed of a self-propelled sea-going vessel resulting typically in more than twice as many fatigue cycles when an offshore structure is towed by barge. Thus, in calm seas as well as rough seas, the number of and severity of fatigue stresses on an offshore structure being towed by barge may be much greater resulting in increased risk of damage over what would be the case if the offshore structure were being carried by a sea-going vessel over the same distance.

Since a barge deck is typically low in the water, an offshore structure is subjected undesirably to the stressful pounding of waves thereagainst. This of course becomes more of a problem as the length of tow is increased and as the seas become rougher. It is thus desirable to raise an offshore structure so that it is disposed higher than and thus out of the way of the waves during a typical storm as well as during other weather conditions.

Since the fabrication yards are usually located near the shallow water, ships for carrying such structures may typically be incapable of getting close enough for loading of the structures directly thereon. In addition, such prefabricated offshore structure may be longer and/or wider than the ships on which it is desirable to load them.

In order to overcome these difficulties, a system and method for long distance ocean transport of such prefabricated offshore structures is desirable which is both fast and safe thus assuring that the components arrive undamaged and on time.

It is therefore an object of the present invention to provide quick, safe, and reliable transportation over an ocean of prefabricated offshore structures from a fabrication yard near shallow water.

It is a further object of the present invention to minimize the number of and severity of fatigue stresses on an offshore structure during ocean transport thereof so as to minimize the risk of damage to the offshore structure.

It is yet another object of the present invention to raise an offshore structure for ocean transport so that it is disposed higher than and thus out of the way of the waves during a typical storm to thus minimize risk of damage to the offshore structure.

It is an object of an aspect of the present invention to provide such transportation of a prefabricated offshore structure wherein the structure is longer than the length of a ship used in the transportation thereof.

It is an object of another aspect of the present invention to provide more efficient transport of bulky prefabricated offshore structures.

A still further object of the invention is to provide a system and/or method for transport of prefabricated offshore structures which renders it practical and commercially advantageous to utilize any suitably outfitted fabrication yard or site to manufacture large bulky offshore structures for installation at desired offshore sites anywhere in the world.

The various features of novelty which characterize the invention are pointed out with particularity in the claims annexed to and forming a part of this disclosure. For a better understanding of the invention, its operating advantages, and the foregoing and other objects attained by its uses, reference is made to the accompanying drawings and descriptive matter in which preferred embodiments of the invention are illustrated.

Figure 14:
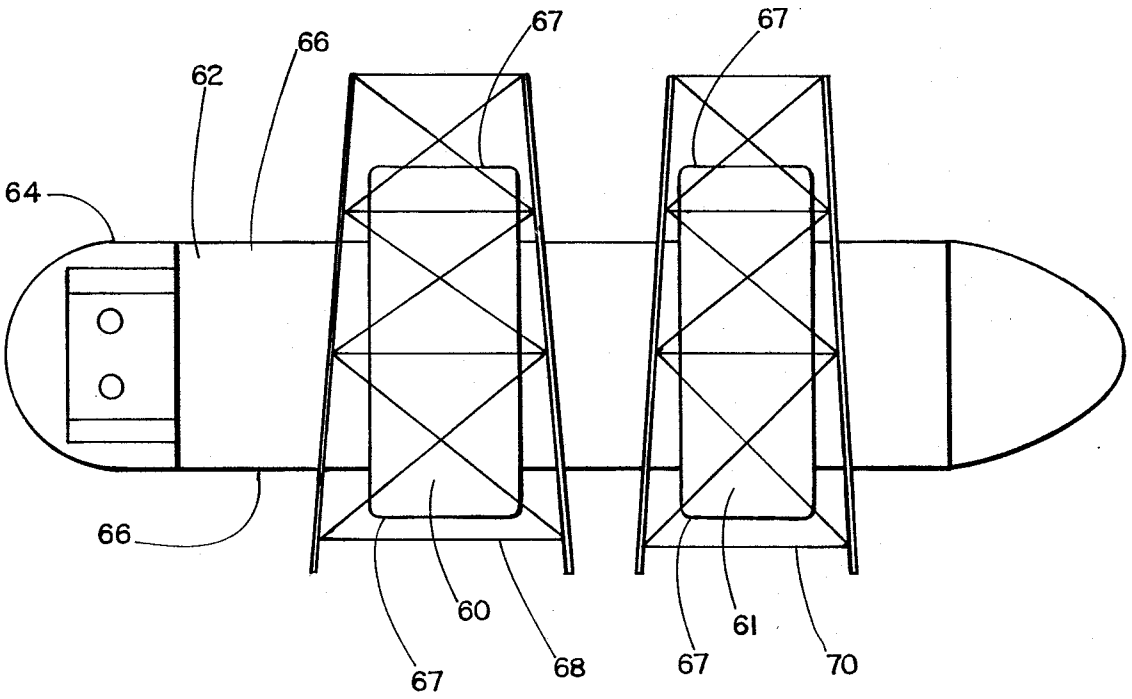

FIG. 13 is a top plan view showing the relative size and orientation of a shallow draft barge used in accordance with the invention and a construction barge for off-loading the shallow draft barge; and FIG. 14 is a schematic plan view of a vessel loaded with two barges positioned cross-wise to the vessel length and carrying two smaller offshore structures in accordance with an alternative embodiment of the invention.

Figure 1:
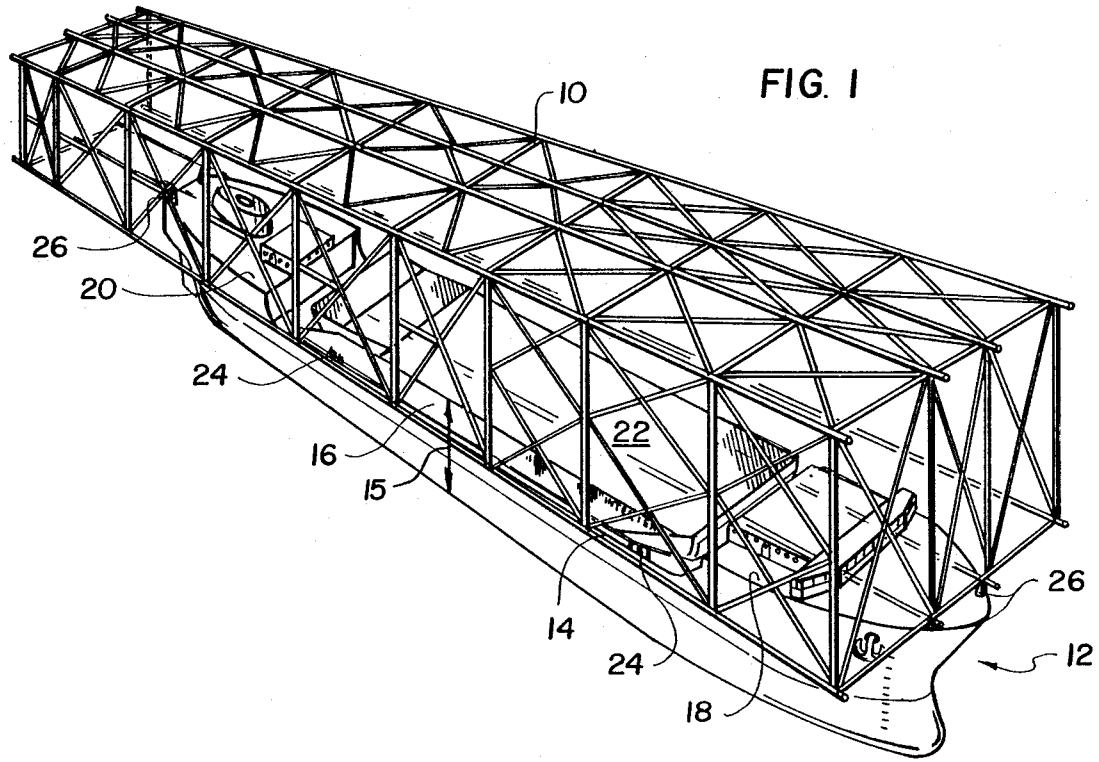
FIG. 1 is a perspective view of a system embodying the invention with a prefabricated offshore structure loaded thereof for transport.

Referring to FIG. 1, there is shown a system for transporting large bulky prefabricated offshore structures such as, for example, drill jacket 10 utilizing a sea-going self-propelled vessel such as the ship generally designated 12. The ship 12 includes a power plant for propulsion as well as ballasting equipment for submerging a mid or well deck 14 to a level which is below the draft of a shallow draft barge 16. Ship 12 includes raised forward and aft decks 18 and 20 respectively. These decks 18 and 20 are provided with a height to remain above the water line and are suitably sized, in accordance with principles of common knowledge to those or ordinary skill in the art to which this invention pertains, to maintain stability and floatation of the vessel while mid deck 14 is submerged to a depth for barge 16 with jacket 10 to be floated over the top of the deck 14. A fixed suitable connection means may be provided for securing the barge 16 to vessel 12 such as the at least four point tie-down system illustrated at 24. Although a drill jacket is used as an example herein, this invention is meant to include procedures and apparatus for transporting various other prefabricated offshore structures such as decks or modules.

Figure 2:
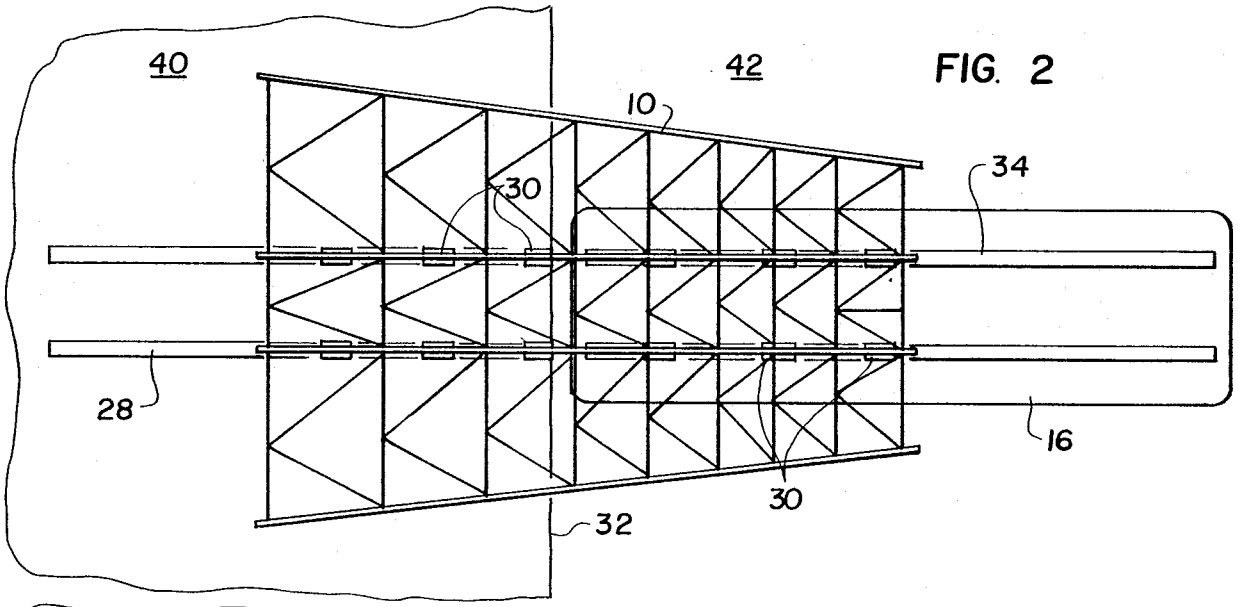
FIG. 2 is a top plan view illustrating the loading of a jacket from a fabrication yard onto a shallow draft barge.
Figure 3:
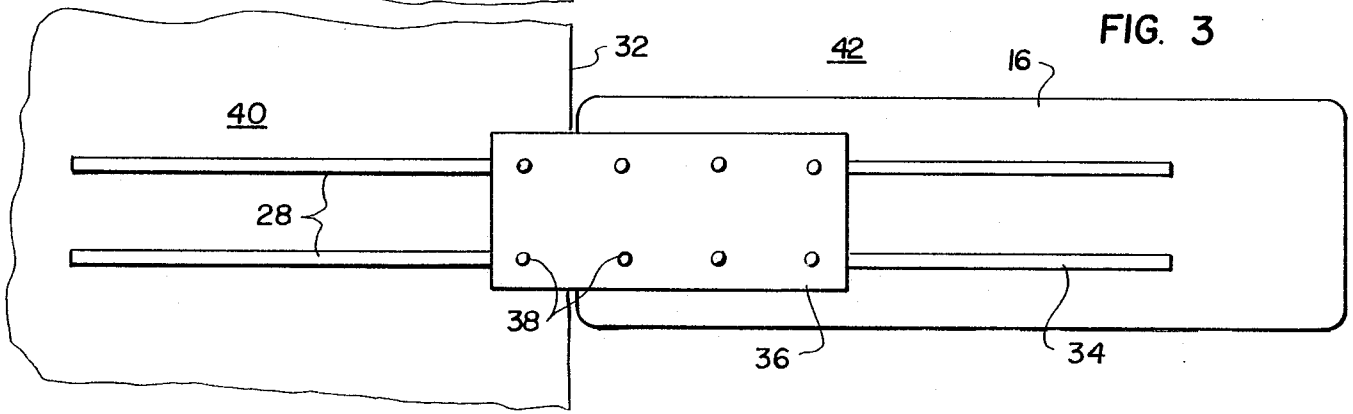
FIG. 3 is a view similar to FIG. 2 illustrating the loading of a deck unit.

In both FIGS. 2 and 3, a fabrication yard 40 is illustrated adjacent shallow water 42 which is sufficiently deep for shallow draft barge 16, but has insufficient depth for positioning ship 12 for loading of a drill jacket 10 directly onto the ship. In order to load drill jacket 10 onto a sea-going vessel for safe and fast ocean transport in accordance with the present invention, the drill jacket 10 is discharged from the fabrication yard 40 onto barge 16 which in turn is towed into deep water (that is; water which is sufficiently deep for a sea-going self propelled vessel such as ship 46 shown in FIG. 4) for loading onto ship 46 as will hereinafter be described.

In FIG. 2, drill jacket 10 is shown being skidded onto shallow draft barge 16 by means such as portable load-out rails or guides 28. Jacket 10 is provided with a plurality of skids 30 which slide along rails 28 and, at the interface between bulkhead 32 and barge 16, onto rails or tracks 34 on the top surface of the barge 16. FIG. 3 shows the loading of an offshore drilling platform deck unit 36 onto a barge 16. Here again, rails 28 and tracks 34 are utilized on which skids slide to support the downwardly extending legs 38 of deck unit 36.

Figure 4:
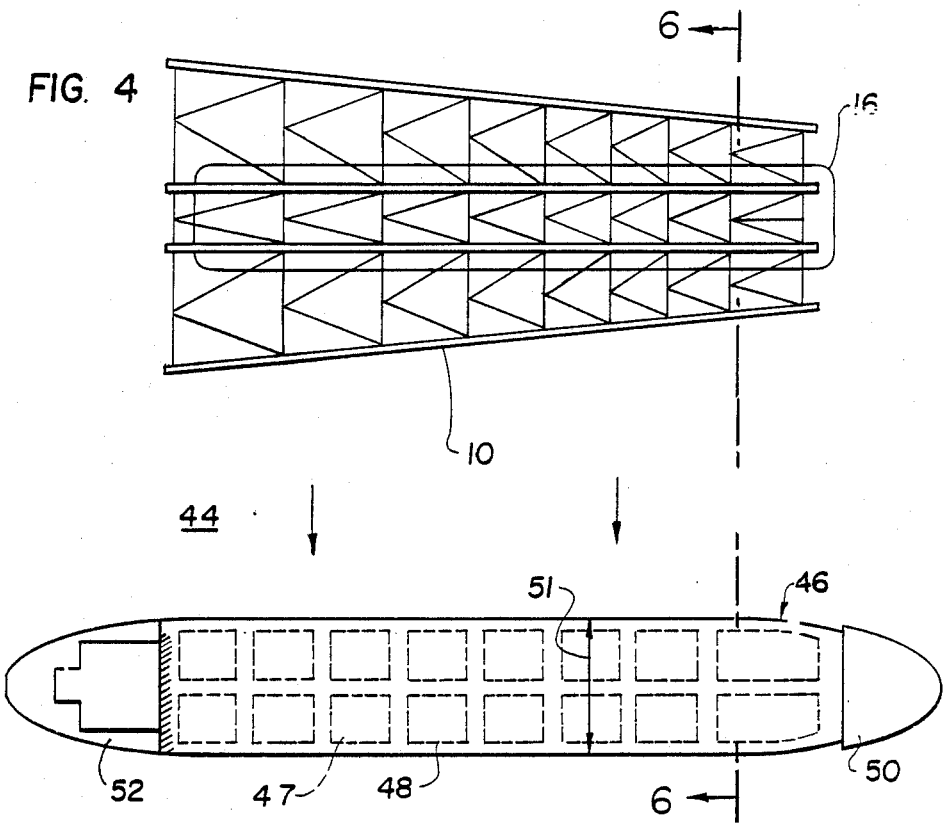
FIG. 4 is a top plan view showing the orientation of a barge loaded with a prefabricated offshore structure to a transport vessel before the barge is floated onto the mid deck of the vessel.
Figure 5:
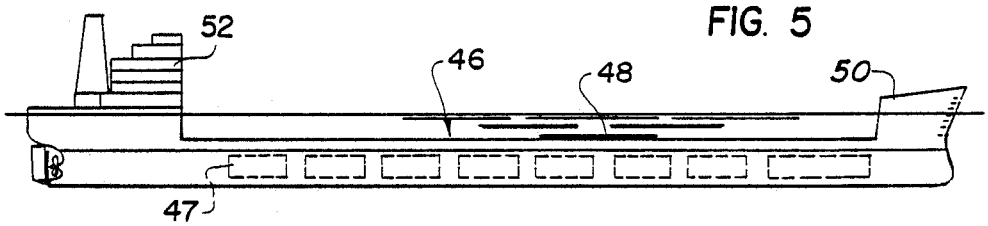
FIG. 5 is a side elevational view of the transport vessel with its mid deck submerged.

After it is loaded, barge 16 is floated and vessel 46 is sailed into the positions shown in FIG. 4 in deep water with respect to each other and, as shown in FIG. 5, vessel 46 is ballasted by means such as ballast tanks schematically indicated at 47 to submerge its mid deck 48. Vessel 46 includes forward and aft raised decks 50 and 52 respectively suitably sized, in accordance with principles of common knowledge to those of ordinary skill in the art to which this invention pertains, for providing sufficient floatation and for maintaining vessel stability while submerging the mid deck 48 for receiving the barge 16.

Figure 6:
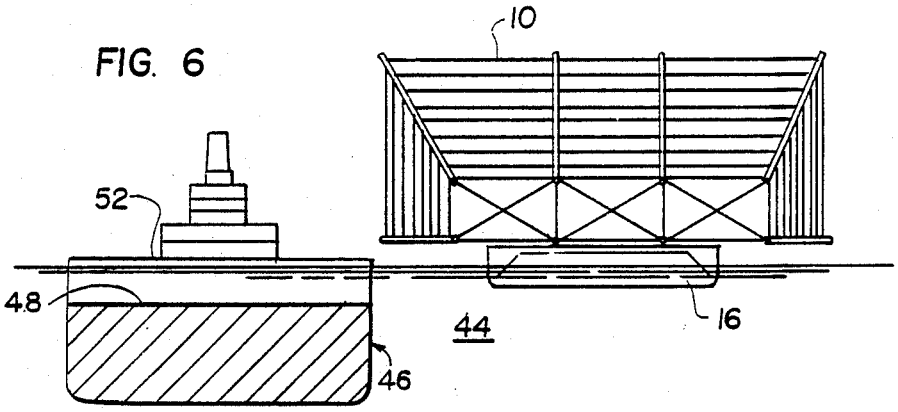
FIG. 6 is an enlarged sectional view taken along line 6—6 of FIG. 4.
Figure 7:
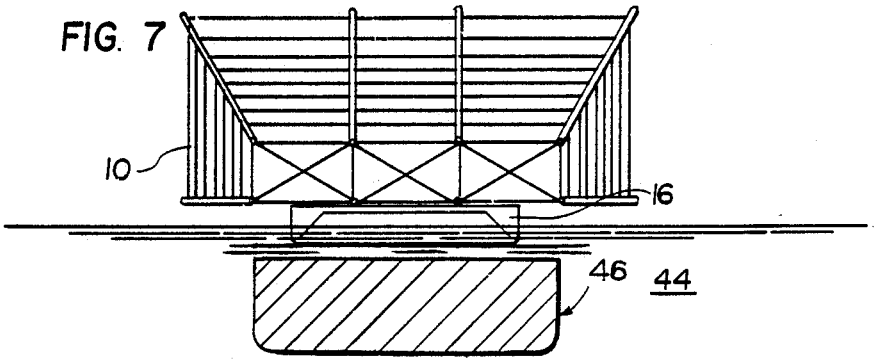
FIG. 7 is a sectional view similar to FIG. 6 with the barge shown positioned over the vessel mid deck.
Figure 8:
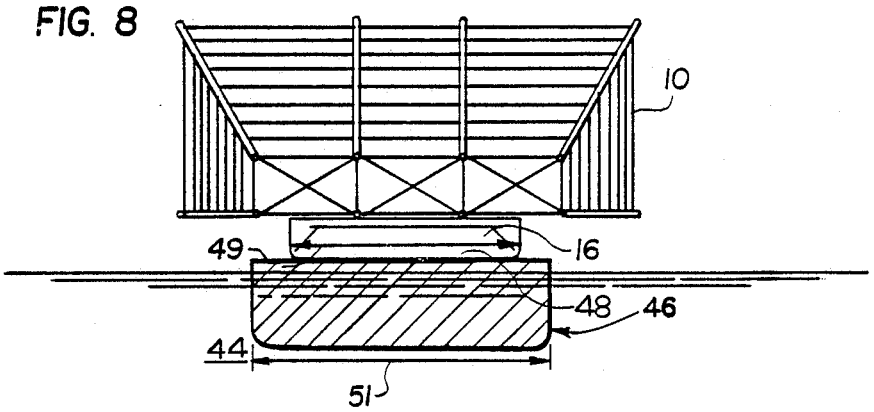
FIG. 8 is a view similar to FIG. 7 after the transport has been floated to support the barge loaded with the prefabricated offshore structure.

FIGS. 6, 7, and 8 show the relative positions of the barge and ship as the two structures are combined to form a single ocean going unit. In FIG. 7, barge 16 is shown floating over the deck 48 which has been submerged to a selected depth sufficient for floating of the barge thereover. As shown in FIG. 8, the vessel 46 is then deballasted to raise the deck 48 above the water line and raise barge 16 with its drill jacket load 10. The vessel 46 should preferably be sufficiently large and stable to support the barge and oversized load during typical rough seas and weather conditions, and such sizing can be determined utilizing principles of common knowledge to those of ordinary skill in the art to which this invention pertains.

When loaded on the barge as shown in FIG. 6, the height of the offshore structure above the water level is less than the overall height of the barge. This is illustrative of the height of the offshore structure during a typical tow by barge. When the offshore structure loaded barge is loaded onto the ship as shown in FIG. 8, the height of the offshore structure above the water is increased so that its height is greater than the overall barge height so that the offshore structure may be disposed higher than and thus out of the way of the waves during rougher seas to thus minimize risk of damage to the offshore structure.

Figure 9:
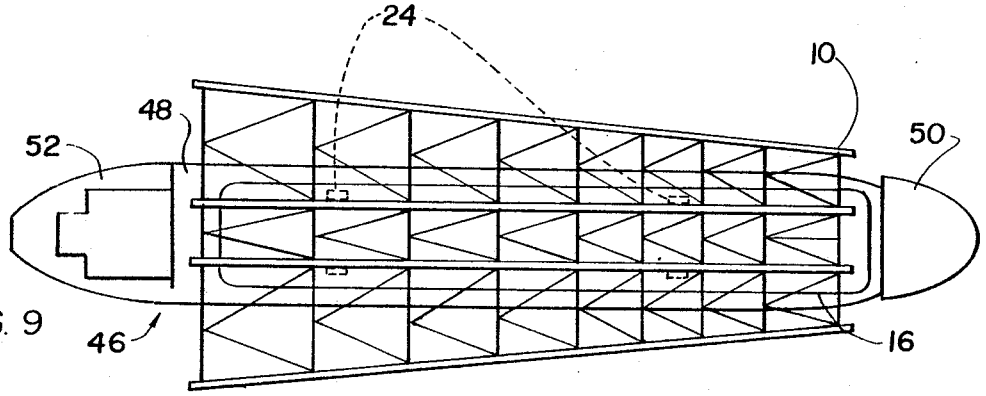
FIG. 9 is a top plan view of the vessel with barge and prefabricated offshore structure assembled for ocean transport.
Figure 10:
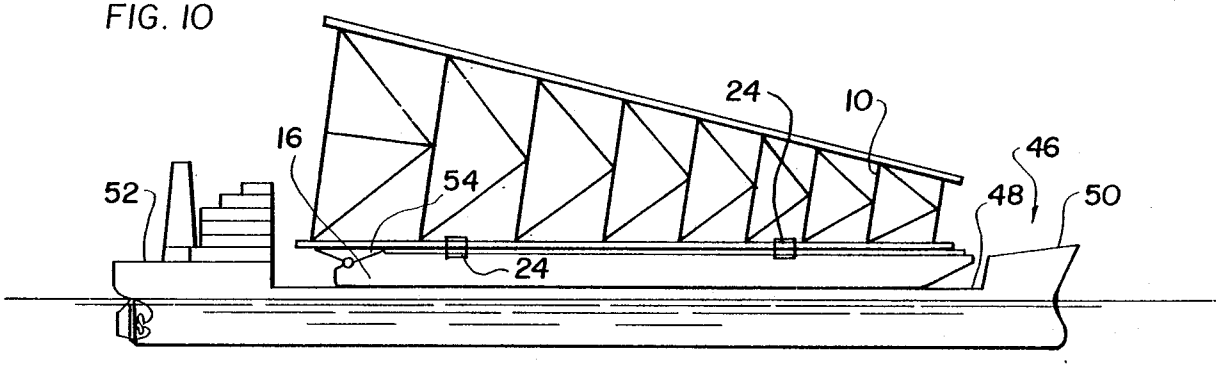
FIG. 10 is a side elevational view of the embodiment shown in FIG. 9.

FIGS. 9 and 10 show the orientation of barge 16 on the vessel. For launching the jacket 10, tie-down connections between the barge 16 and vessel 46 are disconnected, vessel 46 is reballasted to float barge 16 which can then be easily towed away from vessel 46 and to the desired location for launching jacket 10.

Figure 11:
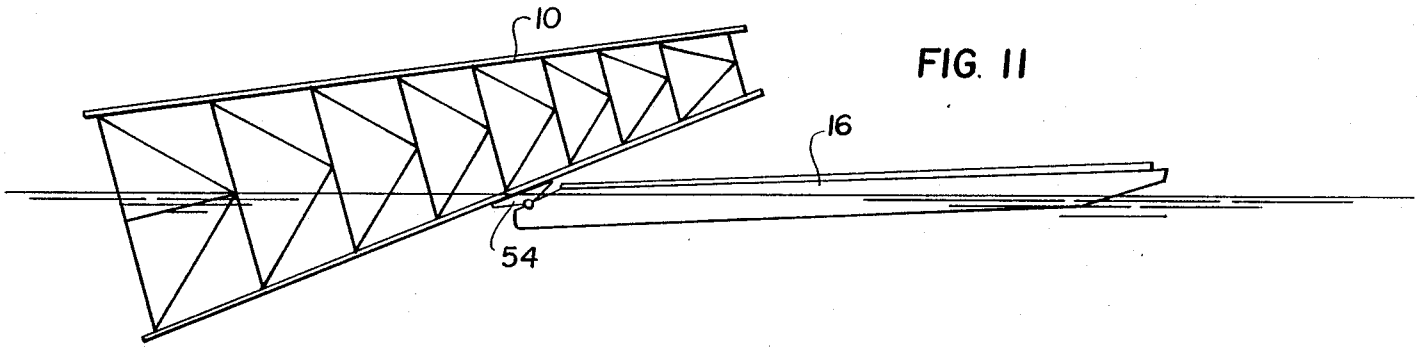
FIG. 11 is a side elevational view showing an intermediate position during the launching of a jacket from a specially designed shallow draft barge.
Figure 12:
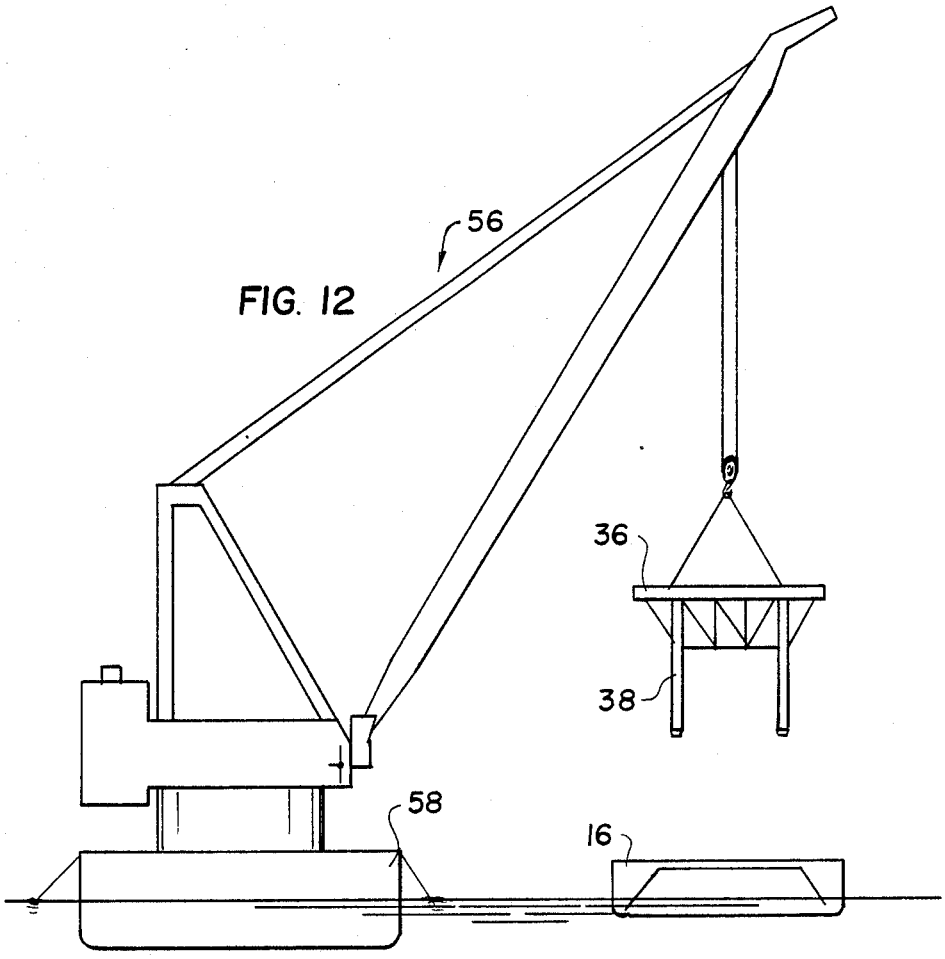
FIG. 12 is a side elevational view of equipment used in off-loading a shallow draft barge used in accordance with the invention.

FIG. 11 shows the barge 16 specially outfitted with a pivot support 54 for launching the jacket 10. To accomplish this, jacket 10 is slid rearwardly on barge 16 so that its center of gravity moves onto support 54. With suitable ballasting of barge 16 while maintaining its stability in accordance with principles of common knowledge to those of ordinary skill in the art to which this invention pertains, jacket 10 is rotated into the water through the pivoting of support 54 thereby launching the jacket into the sea at the desired location. A deck unit 36, as shown in FIG. 12, can be off-loaded from barge 16 using a crane 56 mounted on a derrick or construction barge 58 which is anchored at the offshore site. With jacket 10 already in place, crane 56 is utilized to lift deck 36 from barge 16 and lower it onto the top of jacket 10.

Referring back to FIG. 1, in order to transport a prefabricated offshore structure which has a length greater than the length of the transporter vessel in accordance with an aspect of the present invention, the maximum height of the vessel and barge system is equal to the height illustrated at 15 of the top surface 22 of the barge 16 when the barge is disposed on the well deck 14. In other words, all deck houses and other structures on forward and aft decks 18 and 20 have a height no higher than the supporting surfaces 22 on top of barge 16 which support lower segments of jacket 10. In this way, the elongated jacket 10 can extend beyond the length of barge 16 and over the forward and aft decks 18 and 20 and may extend beyond the forward and aft ends of the vessel. In addition to the tie-down system 24, deck supports 26 may also be provided on forward and aft decks 18 and 20 respectively for supporting the overhanging portions of jacket 10 to further reduce stresses experienced by the jacket during rough sea conditions.

A vessel and barge system embodying the present invention may comprise, for example, a sea going vessel 12 of about 1,050 feet in length with a mid deck 14 of about 700 feet in length. Mid deck 14 may be approximately 175 to 225 feet wide. Such a size may be provided by a converted tanker having a dry weight tonnage of 230,000. A 650 foot barge 16 having a width of 170 feet may be provided to carry a jacket 10 of 40,000 tons. Such a combined structure may deliver the jacket at a cruising speed of about 14 knots or more. While such a vessel may require a water depth for loading and unloading operations of 115 feet or more, the shallow draft barge 16 may operate in as little as 25 feet of water for loading of a drill jacket at a fabrication yard near shallow water. Thus, in accordance with the present invention, an offshore structure may be prefabricated at a fabrication yard near shallow water and then provided with quick, safe, and reliable transportation over an ocean.

Drill jackets and other offshore structures typically have large sizes in comparison to their weights. In order to more effectively utilize the tonnage capacity of a sea-going vessel in accordance with an alternative embodiment of the present invention for transporting smaller offshore structures, one or more barges such as the two barges 60 and 61 illustrated in FIG. 14 are positioned on the well deck 62 of the vessel 64 to extend entirely across the well deck 62 and beyond each side 66 thereof. That is, the barges 60 and 61 extend in a direction cross-wise to the vessel length and their ends 67 overhang the sides 66 of the vessel to provide the capacity for carrying two smaller offshore structures 68 and 70 such as jackets, decks, or modules instead of one such structure.

Certain features of this invention may sometimes be used to advantage without a corresponding use of the other features. While specific embodiments of the invention have been shown and described in detail to illustrate the application of the principles of the invention, it will be understood that the invention may be embodied otherwise without departing from such principles.

We claim:

1. A method of loading a prefabricated offshore structure for transport from a fabrication yard adjacent shallow water to a final site for installation, the method comprising:

floating a barge to a position adjacent the fabrication yard;

skidding the offshore structure from the fabrication yard onto the barge;

floating the barge to a deep water area;

sailing a self-propelled transport vessel having a higher period of roll and lower accelerations than said barge to the deep water area adjacent the barge, the vessel having a mid deck and at least one deck raised above the mid deck;

maintaining the raised deck above water level while ballasting the vessel to submerge the mid deck to a depth which is equal at least to the draft of the barge with the offshore structure disposed thereon;

floating the barge over the submerged mid deck;

deballasting the vessel to raise the mid deck above water level to support the barge and the offshore structure; and securing the barge to the vessel and securing the offshore structure on the barge whereby the offshore structure may be transported over an ocean to a final site for installation, thereby reducing transportation fatigue stresses to the offshore structure.

2. A method according to claim 1 further comprising sizing the vessel and barge such that the maximum height of the vessel and barge system is equal to the height of the top surface of the barge when the barge is disposed on the mid deck whereby the prefabricated offshore structure may extend over the entire length of the vessel.

3. A method according to claim 1 further comprising positioning the barge on the mid deck to extend entirely across the mid deck and beyond each side thereof.

4. A method according to claim 3 further comprising positioning at least two barges on the mid deck so that each barge extends entirely across the mid deck and beyond each side thereof.

* * * * *